US006740830B2

(12) United States Patent
Sato et al.

(10) Patent No.: US 6,740,830 B2
(45) Date of Patent: May 25, 2004

(54) TRIGGER SWITCH

(75) Inventors: Takashi Sato, Tokyo (JP); Tetsuzo Nakazawa, Tokyo (JP); Akio Nakagawa, Tokyo (JP); Takaki Tsutsui, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/234,175

(22) Filed: Sep. 5, 2002

(65) Prior Publication Data

US 2003/0042122 A1 Mar. 6, 2003

(30) Foreign Application Priority Data

Sep. 6, 2001 (JP) ..... P2001-269704
Sep. 10, 2001 (JP) ..... P2001-273730

(51) Int. Cl.[7] ..... H01H 13/70
(52) U.S. Cl. ..... 200/343; 200/61.29
(58) Field of Search ..... 200/11 TW, 522, 200/343, 6 R, 61.1, 61.29, 61.31, 61.39, 61.45 M, 61.7, 61.89, 81 H, 82 E, 83 L, 527, 528, 86.5, 16 R, 61.28, 64.45 M, 831; 335/205–207

(56) References Cited

U.S. PATENT DOCUMENTS

| | | | | | |
|---|---|---|---|---|---|
| 2,535,021 | A | * | 12/1950 | Stone et al. | 200/86 R |
| 3,250,882 | A | * | 5/1966 | Campbell et al. | 200/343 |
| 3,325,618 | A | * | 6/1967 | Sullivan | 200/535 |
| 3,759,115 | A | * | 9/1973 | Dibonaventura et al. | 74/512 |
| 3,800,104 | A | * | 3/1974 | Lien et al. | 200/5 A |
| 4,172,217 | A | * | 10/1979 | Miller | 200/86.5 |
| 5,319,996 | A | * | 6/1994 | Harris | 74/560 |
| 5,535,642 | A | * | 7/1996 | Moll | 74/561 |
| 6,188,229 | B1 | * | 2/2001 | Nakamura | 324/695 |
| 6,274,832 | B1 | * | 8/2001 | Tachibana | 200/343 |
| 6,349,796 | B1 | * | 2/2002 | Tauchi et al. | 187/393 |
| 6,462,499 | B2 | * | 10/2002 | Mukai | 318/568.21 |

* cited by examiner

*Primary Examiner*—Michael Friedhofer
*Assistant Examiner*—Lisa Klaus
(74) *Attorney, Agent, or Firm*—Whitham, Curtis & Christofferson, P.C.

(57) ABSTRACT

A trigger switch includes a trigger member, a rotation detector and a first shaft. The first shaft rotatably supports the trigger member on the rotation detector, so that the rotation detector detects a rotation of the trigger member.

10 Claims, 5 Drawing Sheets

FIG. 5A "Prior Art"
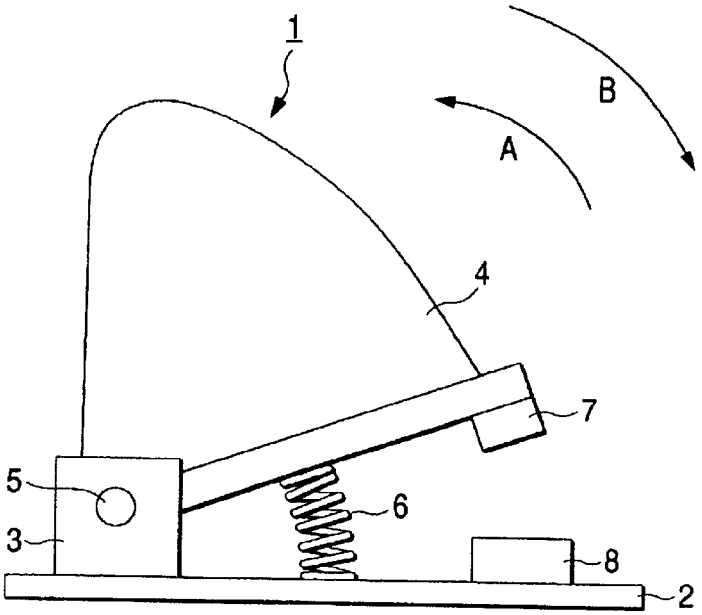
FIG. 5B "Prior Art"
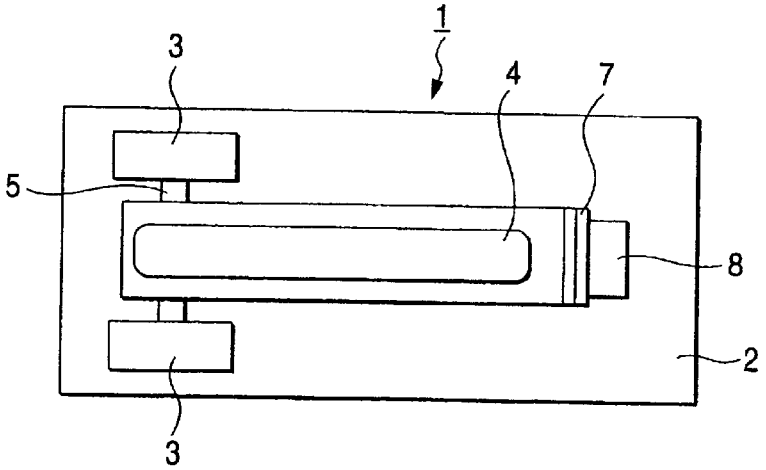

TRIGGER SWITCH

BACKGROUND OF THE INVENTION

This invention generally relates to a trigger switch and, more particularly, to a trigger switch for use in a game controller, in which a trigger is pivotally supported through a rotating shaft and urged by an elastic member in a predetermined pivotal direction.

A related trigger switch is described below with reference to FIGS. 5A and 5B. In the trigger switch 1, bearings 3 are erected on a substrate 2. A rotating shaft 5 provided in a trigger 4 is pivotally supported on the bearings 3. Further, the trigger 4 is pushed in direction A by an elastic member 6 erected on the substrate 2, as shown in FIG. 5A. Furthermore, a magnet 7 is attached to the bottom face of an end portion of the trigger 4, while a magnetic sensor 8 corresponding to the magnet 7 is disposed on the substrate 2.

Thus, when the trigger 4 provided in the trigger switch 1 is turned to an arrow direction B, as shown in FIG. 5A, around the rotating shaft 5, which is employed as the center of rotation, by being pulled by a finger, the magnet 7 provided in the trigger 4 approaches or comes in contact with the magnetic sensor 8. Consequently, the magnetic sensor 8 senses magnetism and then outputs an electrical output corresponding to the magnetism.

However, the magnetic sensor 8 of the trigger switch 1 is susceptible to the influence of ambient magnetism. Thus, there is a fear that such magnetism may affect data precision of the trigger switch 1.

Further, in the case that the rotating shaft 5 and the bearings 3 have backlash, and that the rotating shaft 5 and the bearing portions of the bearings 3 are abraded by iterative operations, the magnetic sensor 8 is affected, so that the data precision is degraded.

SUMMARY OF THE INVENTION

It is therefore an object of the present invention to provide a trigger switch, in which a high-data-precision switch operation can be obtained without being affected by the backlash and abrasion of the bearing and by the ambient magnetic field.

In order to achieve the above object, according to the present invention, there is provided a trigger switch comprising:

a trigger member;

a rotation detector; and a first shaft, which rotatably supports the trigger member on the rotation detector, so that the rotation detector detects a rotation of the trigger member.

In the above configuration, the rotation detector is not affected by the backlash and abrasion of bearing members, which pivotally supports the first shaft, and ambient magnetism, which affect the related trigger switch using the magnetic sensor unit. Consequently, the first trigger switch of the invention can obtain high-data-precision output in response to a trigger operation.

Preferably, the trigger switch further comprises a second shaft provided on the rotation detector; and wherein an end portion of the second shaft has a recessed portion; and wherein an end portion of the first shaft is press-fitted into the recessed portion to couple the first shaft to the second shaft.

Here, it is preferable that the end portion of the first shaft has a protrusion; and wherein the second shaft has a pair of holding portions formed on the recessed portion to hold the protrusion.

In the above constructions, the first shaft of the trigger member is rigidly connected to the second shaft of the rotation detector, that an operation of the trigger member is reliably transmitted therebetween, and that a higher-data-precision output can be obtained.

Preferably, the trigger switch further comprising a second shaft, provided on the rotation detector; and wherein an end portion of the first shaft has a recessed portion; and wherein an end portion of the second shaft is press-fitted into the recessed portion to couple the first shaft to the second shaft.

Here, it is preferable that the end portion of the second shaft has a protrusion; and wherein the first shaft has a pair of holding portions formed on the recessed portion to hold the protrusion.

In the above constructions, the first shaft of the trigger member is rigidly connected to the second shaft of the rotation detector, that an operation of the trigger member is reliably transmitted therebetween, and that a higher-data-precision output can be obtained.

Preferably, the rotation detector is a rotary volume.

Preferably, the rotation detector is a rotary encoder.

Preferably, the rotation detector is an optical rotary encoder.

Preferably, the rotation detector is a mechanical rotary encoder.

According to the present invention, there is also provided a trigger switch comprising:

a trigger member;

a first shaft, integrally provided on the trigger member;

a bearing member, rotatively supporting the first shaft; and a rotation detector, coupled to the first shaft, and detecting a rotation of the first shaft in accordance with a movement of the trigger member.

BRIEF DESCRIPTION OF THE DRAWINGS

The above objects and advantages of the present invention will become more apparent by describing in detail preferred exemplary embodiments thereof with reference to the accompanying drawings, wherein:

FIG. 5A is a front view of a related trigger switch, which illustrates the related art; and FIG. 5B is a plan view of the related trigger switch, which illustrates the related art.

DETAILED DESCRIPTION OF THE PREFERRED EMBODIMENTS

Figure 1A:
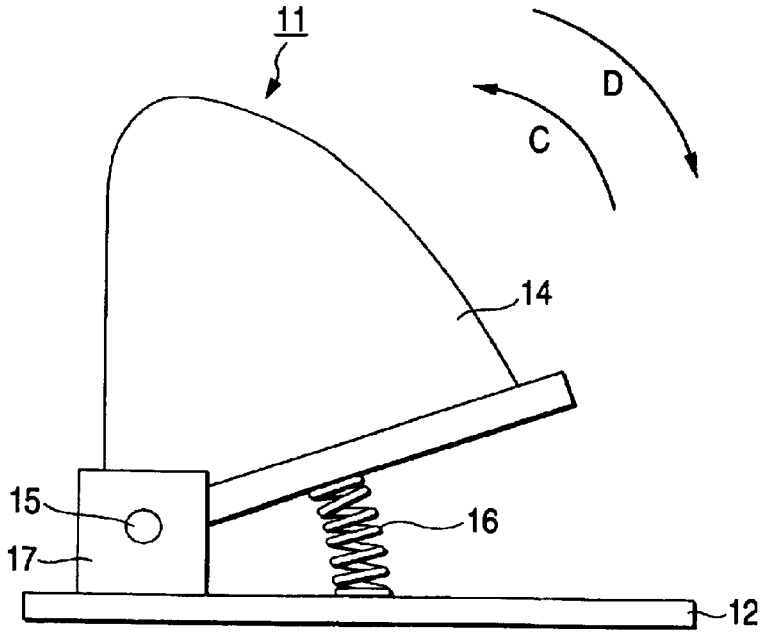
FIG. 1A is a front view of a trigger switch, which illustrates a first embodiment of the invention.
Figure 1B:
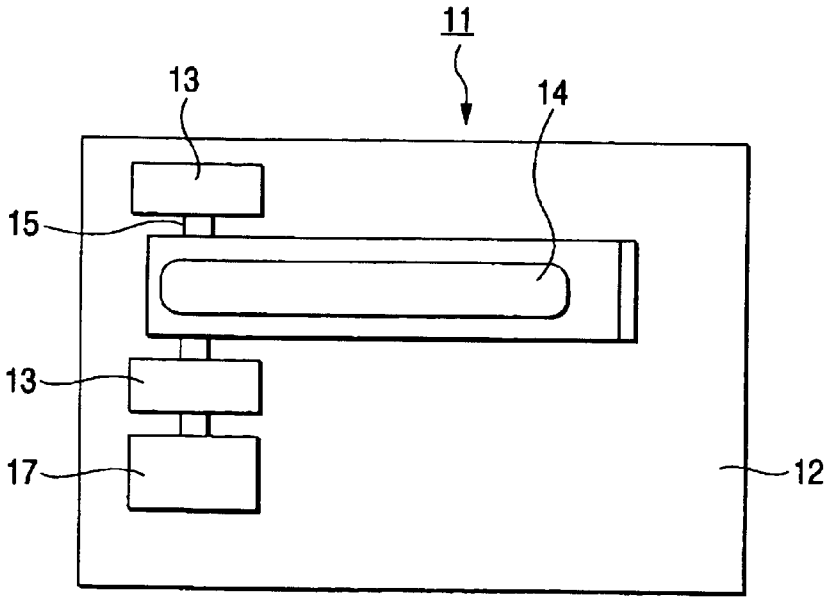
FIG. 1B is a plan view of the trigger switch, which illustrates the first embodiment of the invention.
Figure 2A:
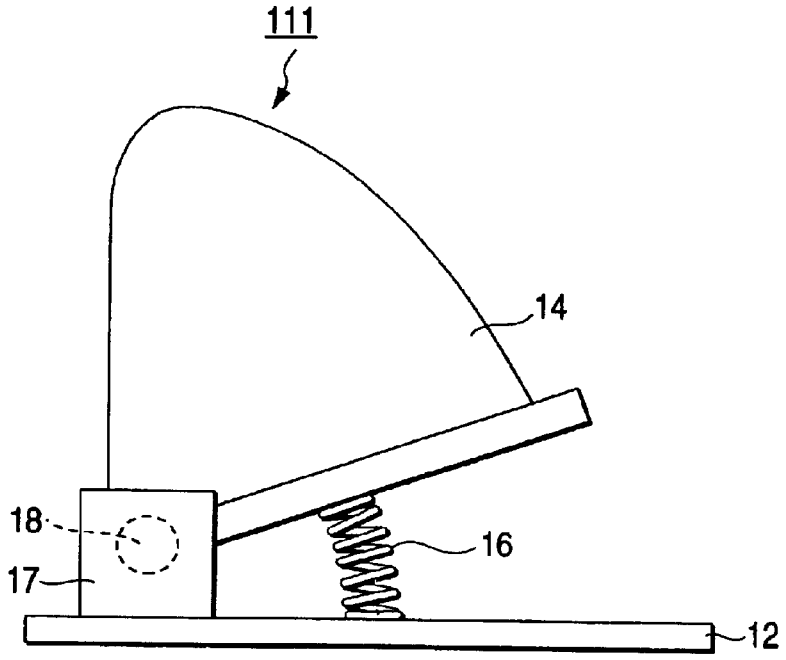
FIG. 2A is a front view of a trigger switch, which illustrates a second embodiment of the invention.
Figure 2B:
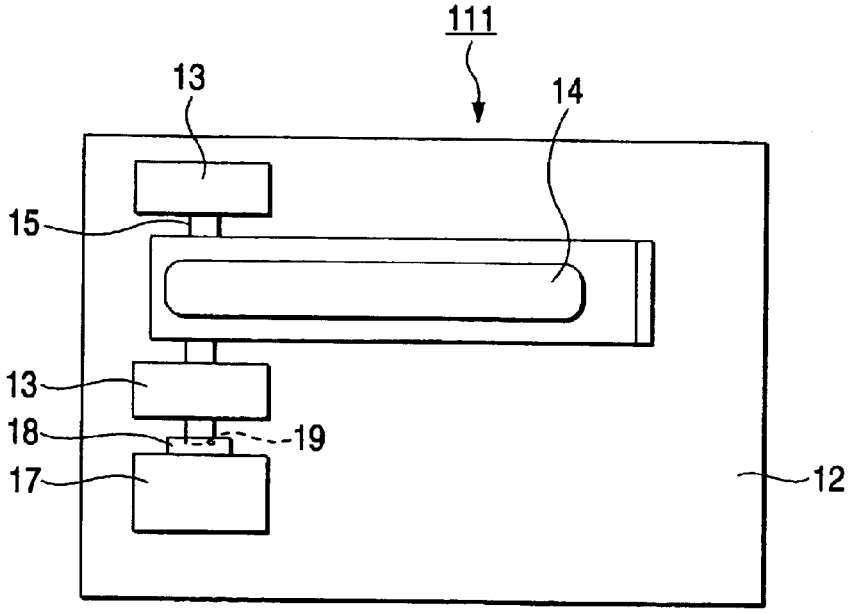
FIG. 2B is a plan view of the trigger switch, which illustrates the second embodiment of the invention.

Hereinafter, a first embodiment of the invention is described in detail with reference to FIGS. 1A and 1B. As shown in FIGS. 1A and 1B, in the trigger switch 11, bearings 13 are erected on a substrate 12. A rotating shaft 15 provided in a trigger 14 is pivotally supported on the bearings 13. Further, the trigger 14 is urged to an arrow direction C by an elastic member 16 securely fixed on the substrate 12, as shown in FIG. 1A.

Further, a rotary volume 17 serving as the rotation detector is connected to an end portion of the rotating shaft 15 of the trigger 14. Incidentally, instead of the rotary volume 17, a rotary encoder, such as an optical rotary encoder or a mechanical rotary encoder, may be used.

Thus, when the trigger 14 provided in the trigger switch 11 is pivoted to an arrow direction D, as viewed in FIG. 1A, with respect to the rotating shaft 15 which, is employed as the center of rotation, by being pulled by a finger, the rotary volume 17 connected to the rotating shaft 15 of the trigger 14 is rotated, so that the rotary volume 17 generates an electrical output corresponding to an amount of rotation thereof.

Thus, because the rotary volume 17 is connected to an end portion of the rotating shaft 15 of the trigger 14, the trigger switch 11 is not affected by the backlash and abrasion of the rotating shaft 15 and the bearing 13 which affect the related trigger switch using the magnetic sensor, or by ambient magnetism. Consequently, a high-data-precision output of a trigger switch in response to a trigger operation can be obtained.

Next, a trigger switch of the second embodiment according to the invention is described in detail with reference to FIGS. 2A to 4. In FIGS. 2A to 4, a trigger switch 111 is same as the trigger switch 11 excepting for a rotating shaft 18. Incidentally, in the trigger switch 111, components as same as the components described in the first embodiment are appended same reference numerals, and the detailed explanations regarding to the components are omitted.

The trigger switch 111 includes the substrate 12, the bearings 13, the trigger 14, the rotating shaft 15. In the trigger switch 111, the rotary volume 17 is formed so that the diameter of the rotating shaft 18 is larger than the diameter of the rotating shaft 15 of the trigger 14. An end portion of the rotating shaft 15 of the trigger 14 is press-fitted into an end portion of the rotating shaft 18 of the rotary volume 17.

Figure 3:
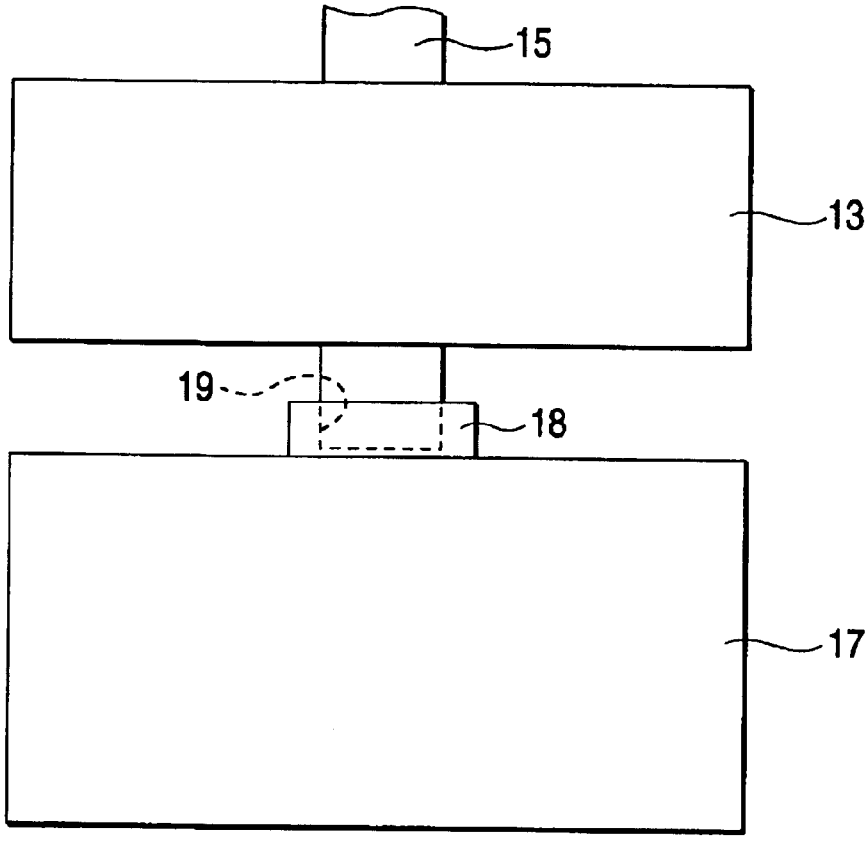
FIG. 3 is a plan view illustrating a connection state between a rotating shaft of the trigger switch and that of a rotary volume, which shows the second embodiment of the invention.
Figure 4:
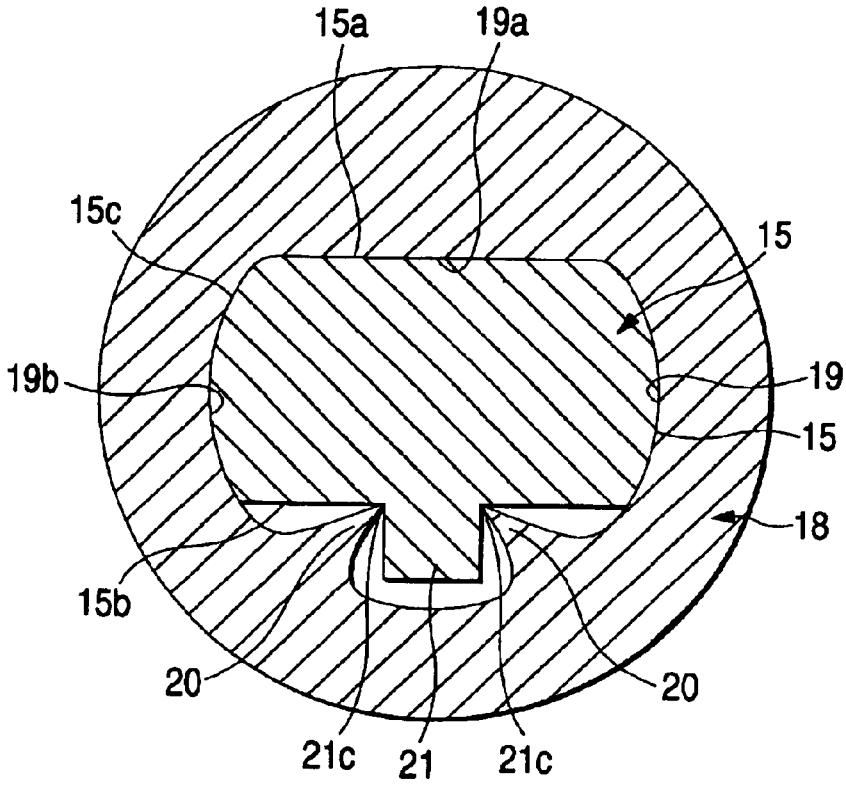
FIG. 4 is a longitudinal sectional view illustrating a connection state between the rotating shaft of the trigger switch and that of the rotary volume, which shows the second embodiment of the invention.

Further, more particularly, as illustrated in FIGS. 3 and 4, in the central part of an end portion of the rotating shaft 18 of the rotary volume 17, a hole 19 extending in the direction of an axis thereof is bored. Moreover, the hole 19 consists of a linear portion 19*a* and circular arc portions 19*b*, as is seen from the sectional view showing the outer-circumferential parts thereof. Furthermore, two elastic holding portions 20 projecting toward the shaft center are provided in the circular arc portions 19*b* in such a way as to be apart from each other by a predetermined distance.

On the other hand, an end portion of the rotating shaft 15 of the trigger 14 consists of two linear portion 15*a* and 15*b*, whose outer-circumferential parts face each other, as shown in the sectional view, and two circular arc portions 15*c* and 15*d*, whose outer-circumferential parts face each other, as shown in the sectional view. Moreover, the linear portions 15*a* and a set of the circular arc portions 15*c* and 15*d* are formed in such a manner as to be closely fitted into the linear portion 19*a* and the circular arc portion 19*b*, respectively. A convex portion 21 sandwiched by the holding portions 20 is formed in the other linear portion 15*b* in such a way as to be protruded between the holding portions 20.

Further, when an end portion of the rotating shaft 15 of the trigger 14 is fitted into the hole 19, end parts of the two elastic holding portions 20 sandwich-press the convex portion 21 at the corners 21*c* of the base part thereof.

Moreover, because the convex portion 21 is sandwich-pressed by the holding portions 20, the rotating shaft 15 of the trigger 14 is tightly connected to the rotating shaft 18 of the rotary volume 17. Thus, an operation of the trigger 14 is reliably transmitted thereto, so that the trigger switch 111 can obtain a higher-data-precision output.

Incidentally, various changes and modifications may be made without departing from the spirit of the invention. Further, needless to say, the invention covers the changes and modifications.

What is claimed is:

1. A trigger switch comprising:

a trigger member;

a rotation detector;

a first shaft, which rotatably supports the trigger member and is connected to the rotation detector, so that the rotation detector detects a rotation of the first shaft; and an elastic member, which urges the trigger member in a pivoting direction of the trigger member.

2. The trigger switch as set forth in claim 1, further comprising a second shaft provided on the rotation detector; and wherein an end portion of the second shaft has a recessed portion; and wherein an end portion of the first shaft is press-fitted into the recessed portion to couple the first shaft to the second shaft.

3. The trigger switch as set forth in claim 2, wherein the end portion of the first shaft has a protrusion; and wherein the second shaft has a pair of holding portions formed on the recessed portion to hold the protrusion.

4. The trigger switch as set forth in claim 1, further comprising a second shaft provided on the rotation detector; and wherein an end portion of the second shaft is press-fitted into the recessed portion to couple the first shaft to the second shaft.

5. The trigger switch as set forth in claim 4, wherein the end portion of the second shaft has a protrusion; and wherein the first shaft has a pair of holding portions formed on the recessed portion to hold the protrusion.

6. The trigger switch as set forth in claim 1, wherein the rotation detector is a rotary encoder.

7. The trigger switch as set forth in claim 1, wherein the rotation detector is an optical rotary encoder.

8. The trigger switch as set forth in claim 1, wherein the rotation detector is a mechanical rotary encoder.

9. A trigger switch comprising:

a trigger member;

a first shaft, integrally provided on the trigger member;

a bearing member, rotatably supporting the first shaft; and a rotation detector, coupled to the first shaft, and detecting a rotation of the first shaft in accordance with a movement of the trigger member.

10. The trigger switch as set forth in claim 1, wherein the elastic member is provided between the trigger member and a substrate.

* * * * *